US006908019B2

(12) United States Patent
Parsons

(10) Patent No.: US 6,908,019 B2
(45) Date of Patent: Jun. 21, 2005

(54) CONCEALABLE BATON SCABBARD

(75) Inventor: Kevin L. Parsons, Appleton, WI (US)

(73) Assignee: Armament Systems & Procedures, Inc., Appleton, WI (US)

( * ) Notice: Subject to any disclaimer, the term of this patent is extended or adjusted under 35 U.S.C. 154(b) by 0 days.

(21) Appl. No.: 10/402,650

(22) Filed: Mar. 28, 2003

(65) Prior Publication Data

US 2004/0188477 A1 Sep. 30, 2004

(51) Int. Cl.[7] ..... A45C 1/04

(52) U.S. Cl. ..... 224/587; 224/673; 224/251; 224/914

(58) Field of Search ..... 224/587, 673, 224/251, 914

(56) References Cited

U.S. PATENT DOCUMENTS 1,898,171 A * 2/1933 Bunnell ..... 224/673
2,954,909 A * 10/1960 Miller et al. ..... 224/200
5,449,104 A 9/1995 Parsons et al.
5,511,336 A * 4/1996 Bishop ..... 43/21.2
5,533,657 A * 7/1996 Rosen et al. ..... 224/673
5,617,980 A * 4/1997 Parsons et al. ..... 224/251
5,667,441 A 9/1997 Parsons
6,059,157 A 5/2000 Parsons et al.
2003/0085244 A1 * 5/2003 Parsons ..... 224/197

* cited by examiner

*Primary Examiner*—Stephen K. Cronin
(74) *Attorney, Agent, or Firm*—Welsh & Katz, Ltd.

(57) ABSTRACT

A concealable baton scabbard or carrier for use with an expandable baton includes a tubular cylindrical baton housing having an interior chamber adapted to receive a baton. First and second wing members are attached to substantially diametrically opposite sides of the baton housing and each wing member has at least one belt receiving slot adapted to receive a belt that can be worn about the user's waist. The baton scabbard is configured so that the wing members and baton housing establish an outer profile when worn on a belt that does not deviate significantly from a normal line of tension created by the belt whereby the scabbard or baton are substantially undetectable under an article of outer clothing worn by the user in overlying relation to the scabbard.

37 Claims, 2 Drawing Sheets

CONCEALABLE BATON SCABBARD

FIELD OF THE INVENTION

The present invention relates generally to baton carriers or scabbards for releasably holding a baton such as used by law enforcement, security and military personnel, and more particularly to a baton scabbard configured and adapted to be worn, as on a belt or strap secured around the user's waist, under an article of outer clothing so that the scabbard and associated baton are substantially concealed and undetectable.

BACKGROUND OF THE INVENTION

It is frequently necessary for law enforcement and security personnel to carry an intermediate force weapon on their person. The weapon of choice is an extendable tactical baton which is lightweight, easy-to-carry, may be worn at the belt of the law enforcement and security personnel, and may be quickly drawn to a ready position. An example of such a tactical baton is the ASP TACTICAL BATON manufactured by Armament Systems and Procedures, Inc., the assignee of the subject invention. The ASP baton includes one or more telescoping sections that may be retracted into a handle portion so as to provide a cylindrical retracted baton of approximately seven to twelve inches in length and about one inch in diameter. Depending on its retracted length, the baton can approximate 16–31 inches in length when extended.

Typically, a law enforcement or security officer will carry the baton on his person in its retracted condition and will draw the baton from a scabbard, alternatively termed a carrier or holster, across his body into an at-ready position. A drawing and snapping action extends the baton to its fully expanded position. The baton may be stowed in the scabbard by retracting it and replacing it in the scabbard. Baton scabbards used by security and law enforcement personnel for stowing a baton are typically designed to be carried on a belt or strap secured about the user's waist, usually externally of the user's primary clothing so that the baton is stowed in a readily accessible position.

Situations frequently occur for security and law enforcement personnel in which it is highly desirable that the baton and associated scabbard be carried in a concealed and substantially undetected manner, for example, under the officer's outer clothing such as a jacket or coat, and yet still be readily accessible for quick removal and at-ready positioning of the baton. A typical situation in which security personnel are required to carry a baton in a concealed manner is when attending a function for dignitaries where the officer's weapons must be concealed and substantially undetectable under semiformal or formal civilian clothing. Other occasions may also call for the security officer's baton and scabbard to be concealed and not readily detectable under the officer's clothing.

Baton scabbards are known that are attachable to the belts of security and law enforcement personnel for carrying a baton. However, when worn under outer clothing such as a coat or jacket, the known baton scabbards generally result in outward bulging of the outer clothing. Other baton scabbard designs that enable the baton to be carried elsewhere on the body of the law enforcement officer, such as generally on the chest or torso, allow the officer ready access and release of the baton from its scabbard but often also result in outward detectable bulging of any overlying clothing.

Thus, there is a need for a baton scabbard or carrier that can be worn by security and law enforcement personnel in such a manner that the scabbard and associate baton are concealed and substantially undetectable under the user's clothing and yet enable the baton to be readily accessed and withdrawn from the scabbard.

BRIEF SUMMARY OF THE INVENTION

In accordance with the present invention, a baton carrier or scabbard is provided that allows a baton to be concealed using a soft flexible case but employing a rigid inner tubular core configured to allow the baton to be readily inserted into the core and rapidly removed. To this end, an elongated rigid tubular baton receiving core or sleeve defines a generally cylindrical interior baton receiving chamber having an open upper end and partially closed bottom end. A pair of flexible wing members are formed by molding on diametrically opposite sides of the rigid core and overmolding or encircling the rigid core so as to provide a comfortable feel and aid in concealment of the scabbard and a baton stowed in the core. The flexible wing members, which may alternatively be termed wing panels, are thus attached to substantially diametrically opposite sides of the baton receiving core so as to lie generally in a plane containing the longitudinal axis of the tubular core in their non-flexed condition. The wing members are preferably made of a moldable soft flexible material, such as a suitable plastic, that enables flexing of the wing members in directions generally normal to their major surface areas relative to their lines of connection to the baton receiving core.

Each of the wing members includes means in the form of selectively positioned through-slots that are adapted to receive a belt or strap for securing the scabbard about the user's torso, such as at waist height, so as to allow ready access to and removal of a baton stowed in the scabbard and, conversely, re-stowing of the baton into the scabbard after use. The slots are preferably formed in laterally opposite pairs symmetrical about the axis of the baton receiving housing. A belt or strap can be inserted through a pair of laterally opposite slots so that the belt lies along the inner side of the baton housing relative to the user's body, thereby not deviating significantly from the normal line of belt tension when secured about the waist. The flexible wing members are caused to flex inwardly to the user's torso by the belt so that a relatively smooth outer contour surface is established by the scabbard that deviates only slightly from the normal line of tension created by the belt when taut about a user's waist. In this manner, when the scabbard is worn, for example at the user's waist height, the outer exposed surfaces of the scabbard wing members and the associated baton receiving core or sleeve establish a relatively uniform outer contour surface so that an overlying article of clothing engaging the scabbard and baton does not exhibit a significant outwardly detectable bulge revealing the underlying intermediate force weapon. By selective positioning of the belt receiving slots in the scabbard wings, the scabbard can be worn with the rigid baton receiving core disposed generally vertically or at a selected inclined angle relative to vertical. The belt or strap receiving slots in the scabbard wing members preferably have one or more breakaway bars formed integral with the corresponding wing members and extending generally transversely of the slots. The breakaway bars enable selective removal to extend the lengths of the slots to accommodate use of the scabbard with different width belts or straps.

In the preferred embodiment, the upper open end of the baton receiving core is beveled relative to the longitudinal axis of the housing downwardly away from the user's body so as to create a slightly elevated rear portion of the core.

This enables the tip of the baton to be indexed against the elevated rear portion of the case and facilitate insertion of a baton into the core, as when re-stowing it after use. The bottom end of the baton receiving core is partially closed by a transverse flange that prevents the tip of a baton handle from passing below the bottom of the baton core but allows the tip end of an expanded baton to extend through the bottom of the baton core, as when re-holstering an expanded baton. The tubular handle of an expandable baton typically has a foam type gripping surface and tapers slightly inwardly toward the tip end of the baton handle. Because of this, and the fact that the baton receiving chamber in the rigid baton receiving core is generally cylindrical, the baton receiving core preferably has one or more radially inwardly extending retention ribs or pads formed on its interior cylindrical surface for engaging approximately the lower one-third of the baton handle when inserted into the core, thus preventing full surface contact of the baton with the interior wall of the chamber and facilitating rapid release and removal of a stowed baton.

It will understood that the concealable scabbard in accordance with the present invention is not restricted to use by law enforcement and security officers, but finds application by persons in other capacities, such as private investigators and security guards and the like.

Further objects, features and advantages of the present invention will become apparent from the following detailed description taken in conjunction with the accompanying drawings in which like reference numerals identify like elements throughout the several views.

DETAILED DESCRIPTION

Figure 1:
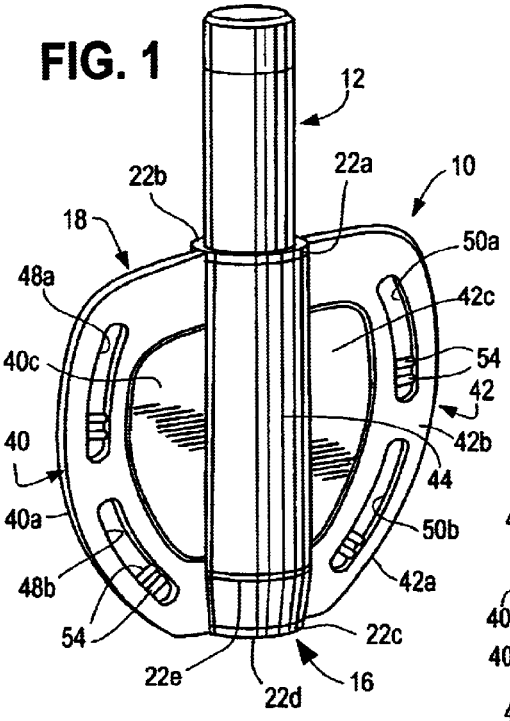
FIG. 1 is a perspective view of a concealable baton scabbard constructed in accordance with the present invention and illustrated attached to a belt such as worn by security and law enforcement personnel and having a baton stowed within the scabbard.

While the present invention is susceptible of embodiments of various forms, there is shown in the drawings and will hereinafter be described some exemplary and non-limiting embodiments, with the understanding that the present disclosure is to be considered as exemplary of preferred embodiments of the invention and is not intended to limit the invention to the specific embodiments illustrated and described.

Very generally, a concealable baton scabbard constructed in accordance with the present invention is particularly adapted for use with an intermediate force weapon in the form of an expandable baton and enables the scabbard to be conveniently worn on a belt or strap disposed generally about a user's waist beneath an article of clothing, such as an outer coat or jacket, so as to eliminate significant detectable bulging of the overlying clothing. Typical expandable batons include a tubular handle portion and at least one telescoping tubular section that can be extended from and retracted into the handle portion. When a belt is worn, for example, about one's waist with nothing attached to it, the belt defines a normal line of tension that coincides with the path of the belt around the user's waist. When an item, such as a scabbard for supporting an intermediate force weapon, is clipped or otherwise attached to the belt, it typically extends outboard of the belt line of tension and produces a corresponding bulge or outward distortion of any outer clothing that overlies the attached item, thereby providing a visual indication that something is under the outer clothing. This can present a problem when a suit coat or the like is worn by a security officer who may wish to appear as a causal observer and not be readily detected as possibly having a weapon stowed beneath his clothing.

Referring now the drawings, and in particular to FIGS. 1–4, one embodiment of a concealable baton scabbard in accordance with the present invention is indicated generally at 10. The scabbard 10, which may alternatively be termed a carrier or holster, is particularly adapted to releasably support an intermediate force weapon, such as an expandable baton 12, on a user's belt or the like, a fragmentary portion of which is indicated at 14 in FIG. 8, adapted to be worn about the user's waist so that the scabbard and baton are substantially undetectable under an article of clothing, such as a coat or jacket, worn by the user in overlying relation to the scabbard. As will become apparent, the concealable baton scabbard 10 finds particular application with security and law enforcement personnel where it is desired that an intermediate force weapon carried by the user be substantially undetectable under the user's outer clothing.

The concealable scabbard 10 includes an elongated rigid cylindrical tubular baton receiving core or sleeve 16 that is connected to attachment means, indicated generally at 18, for attaching the scabbard to the belt or strap 14. The baton receiving core 16, which may alternatively be termed a tubular housing, is adapted to receive and releasably support the baton 12 so that when the scabbard is supported on a belt disposed about the user's waist, minimal outwardly bulging of the overlying clothing is observable.

Figure 2:
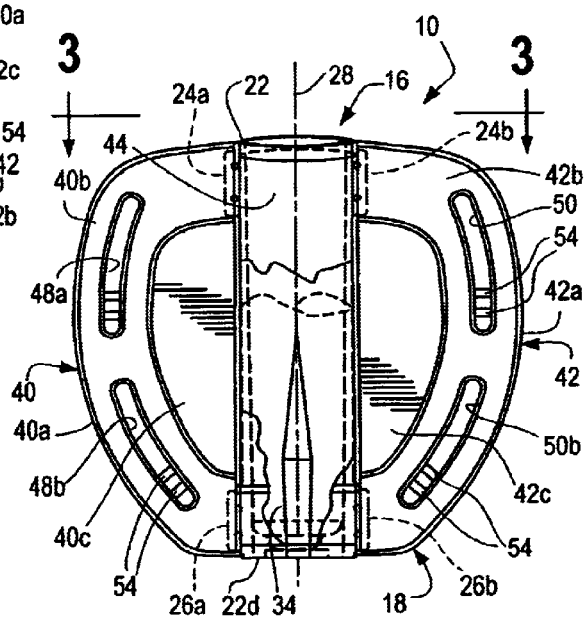
FIG. 2 is a front elevational view, partially in longitudinal section, of the scabbard of FIG. 1 with a portion of the baton shown in phantom.
Figure 5:
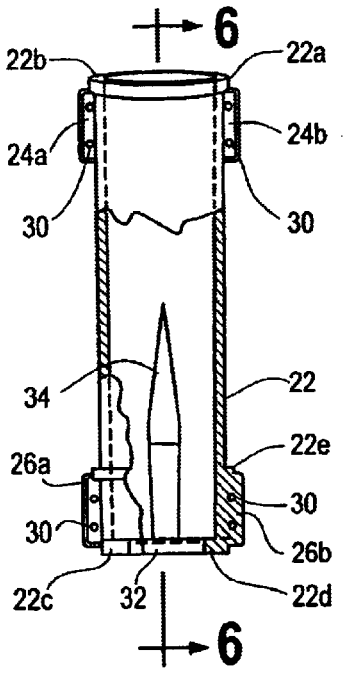
FIG. 5 is an elevational view of the baton receiving housing or sleeve employed in the scabbard of FIG. 1, a portion being broken away for clarity.
Figure 6:
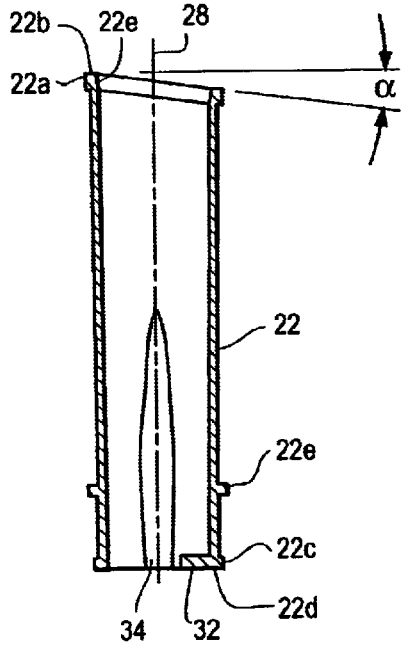
FIG. 6 is a longitudinal sectional view taken substantially along line 6—6 of FIG. 5.

Referring to FIG. 2 taken in conjunction with FIGS. 5 and 6, the baton receiving core 16 includes a rigid tubular sleeve 22 that is preferably made of a lightweight corrosion resistant material, such as a suitable plastic, having an annular rim 22*a* formed about its open upper end 22*b*, an annular rim 22*c* formed adjacent its lower end 22*d*, and an intermediate annular rim 22*e* spaced upwardly from the lower rim 22*c*. The rigid tubular sleeve 22 has a first pair of rectangular tabs 24*a* and 24*b* formed integral therewith so as to extend generally radially outwardly from diametrically opposite sides of the cylindrical sleeve adjacent its upper open end 22*b*. A similar second pair of rectangular tabs 26*a* and 26*b* are formed integral with the tubular sleeve 22 adjacent its lower end interposed between the annular rims 22*c* and 22*e* and extending generally radially from diametrically opposite sides of the sleeve so that all of the tabs 24*a,b*, 26*a,b* lie in a common plane containing the longitudinal axis of sleeve 22, as depicted by line 28 in FIG. 2. As shown in FIG. 5, the tabs 24*a,b* and 26*a,b* preferably have at least two openings extending therethrough, as indicated at 30, to facilitate attachment of wing members to the sleeve 22 by a molding process as will be described.

The lower end 22*d* of sleeve 22 has a transverse flange 32 formed integral therewith so as to extend generally radially inwardly from the lowermost forward edge of the sleeve and thereby partially close the lower end of the sleeve, as shown in FIGS. 3–8. The lower forward edge of the sleeve 22 may also be considered to be the outermost surface of the rigid sleeve when the scabbard is worn about the user's waist, the inner surface of the sleeve being closest to the user's body. The flange 32 extends radially inwardly toward the longitudinal axis of the sleeve sufficiently to prevent a collapsed baton from falling through the scabbard outwardly of the lower end and also prevent the telescopically retracted extendable sections of the collapsed baton from being accidentally jarred open and expanding, but allows the extended sections of an expanded baton to pass through the partially open lower end when inserting or re-holstering an expanded baton into the scabbard.

The upper exposed edge of the open end 22*d* of the baton receiving sleeve 22 is inclined relative to the longitudinal axis 28 of the sleeve from the rearward surface or wall to the forwardmost surface or front wall of the rigid sleeve 22. In this manner, the tip of a retracted baton or tip end of an expanded baton can be indexed against the higher rear surface of sleeve 22 to facilitate insertion of a cylindrical baton into the baton receiving sleeve, and when re-stowing it after use. The angle of incline alpha is preferably in the range of approximately about 5–15 degrees, and more preferably about 7 degrees, relative to the longitudinal axis of the sleeve 22. With the scabbard 10 attached to a user's belt the lower end of a collapsed baton can be indexed against the higher rear wall surface of sleeve 22 and readily slid down the back wall until the tip end of the baton engages the flange 22 of the sleeve without having to orient the baton to a position substantially coaxial with the longitudinal axis of the sleeve to initiate entry. As aforedescribed, when an expanded baton is re-holstered into the scabbard, the outermost tip of the extended baton sections is indexed against the higher rear wall of the sleeve 22 and slid down the rear wall past the flange 32 until the open end of the baton handle engages flange 32 and prevents further insertion of the baton. The inner peripheral edge of the upper end 22*b* of sleeve 22 is preferably chamfered or beveled at 22*e* (FIG. 6) to further facilitate entry of a baton.

As shown in FIG. 2, the handle portion of a typical baton 12 is tapered inwardly toward the end 12*a* that receives one or more extendable telescoping sections so that the peripheral surface of the tapered end is spaced inwardly from the adjacent inner annular surface of the sleeve 22. The rigid baton receiving sleeve 22 preferably has at least one, and preferably four equally circumferentially spaced elongated retention ribs or pads 34 formed on its inner surface such as being molded onto or otherwise affixed to the inner surface of the sleeve 22. The retention ribs 34 are sized to frictionally engage and releasably retain a baton 12 within the sleeve 22 so as to reduce the force necessary to withdraw the baton but prevent inadvertent release of a stowed baton. As illustrated in FIGS. 5 and 6, the retention ribs 34 preferably extend from the lower end of the sleeve 22 to a position wherein the ribs engage approximately the lower one-third of the length of the baton.

Figure 7:
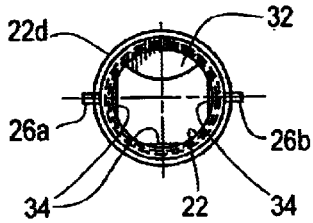
FIG. 7 is a bottom view of the baton receiving housing of FIG. 5.

Referring now to FIGS. 1–4, taken in conjunction with FIGS. 5–7, the attachment means 18 preferably takes the form of a pair of wing members or panels 40 and 42 that are affixed to diametrically opposite sides of the baton receiving sleeve and lie generally in a plane containing the longitudinal axis 28 of the housing sleeve and the tabs 24*a,b* and 26*a,b*. The wing members 40 and 42 are preferably made of a suitable plastic, such as polyurethane, having a soft "touch" and being non-rigid so as to enable flexing about their respective lines of connection to the sleeve 22. The wing members 40 and 42 may be formed by a suitable molding process so that the wing members are integral with an annular wall 44 of similar molded plastic formed coaxially about and in contact with the baton receiving sleeve 22. The molded wing members or panels attach to the tabs 24*a,b* and 26*a,b* through the holes 30 formed in the tabs. In this manner, the wing members or panels 40, 42 and associated molded annular wall 44 are prevented from rotational sliding about the sleeve 22.

Figure 3:
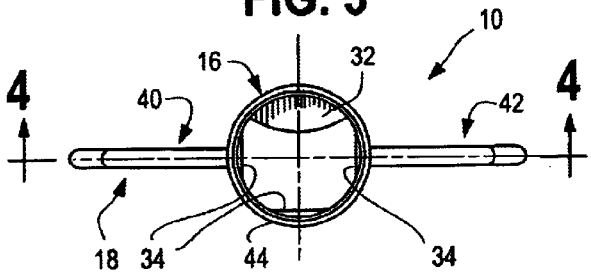
FIG. 3 is a top plan view of the concealable baton scabbard of FIG. 2 taken substantially along line 3—3 of FIG. 2.
Figure 4:
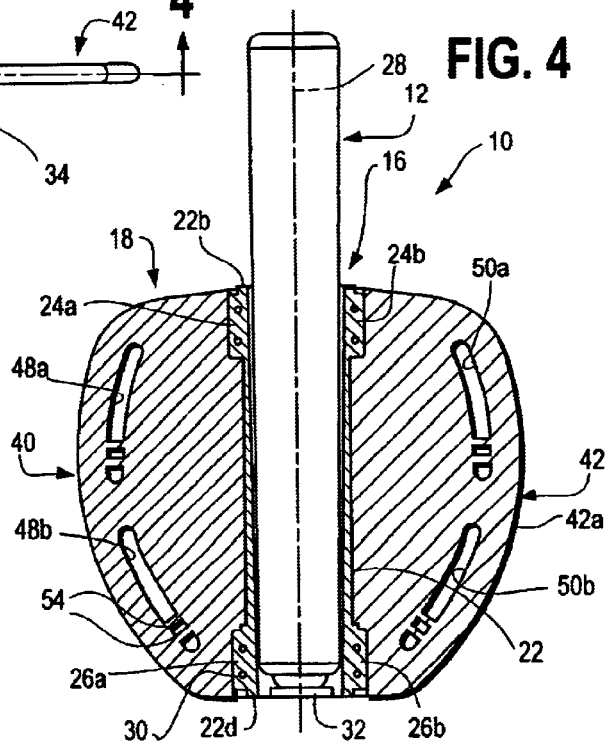
FIG. 4 is a longitudinal sectional view taken substantially along line 4—4 of FIG. 3 but with a baton shown in elevation within the scabbard.

As illustrated in FIGS. 1–3, the wing members 40 and 42 are symmetrical about the longitudinal axis 28 of the baton receiving housing 16 and have generally arcuate shaped outer peripheral edges 40*a* and 42*a*, respectively. The wing members are preferably formed of equal transverse thickness and each defines an outer generally arcuate portion 40*b* and 42*b*, respectively, of greater thickness than a corresponding web portion 40*c* and 42*c* that is formed integral with and extends between the arcuate outer portion and the annular wall 44. The upper and lower ends of the thicker arcuate portions 40*b* and 42*b* of the wing members are molded to the corresponding pairs of tabs 24*a,b* and 26*a,b* formed on the baton receiving housing sleeve 22.

The wing members 40 and 42 each have a pair of generally arcuate shaped slots, indicated at 48*a,b* and 50*a,b* respectively, formed therethrough so that the slots establish laterally opposite pairs of slots 48*a*, 50*a* and 48*b*, 50*b* on diametrically opposite sides of the baton receiving sleeve. The diametrically opposed slots 48*a*, 50*a* and 48*b*, 50*b* are operative to receive a belt 14 of a user when it is desired to carry the baton scabbard so that a baton stowed in the scabbard is disposed in a generally vertical orientation. Should it be desired to orient the scabbard at an inclined angle relative to vertical so that the baton extends forwardly at an angle to vertical for easier access and withdrawal across the user's chest, the belt 14 may be inserted through the slots 48*a* and 50*b* or 48*b* and 50*a*, depending upon which side of the waist the user wishes to carry the baton, thus enabling the user to carry the baton in a forwardly inclined position when worn on either the left or right-hand side of the user's waist.

Each of the belt receiving slots 48*a,b* and 50*a,b* has a plurality of substantially identical breakaway bars, such as indicated at 54, that are preferably molded of plastic with the wing members so as to be integral therewith and extend transversely of the slots. Removing one or both of the breakaway bars results in a longer length slot for receiving larger width belts or straps for wearing the scabbard on the user's waist.

Figure 8:
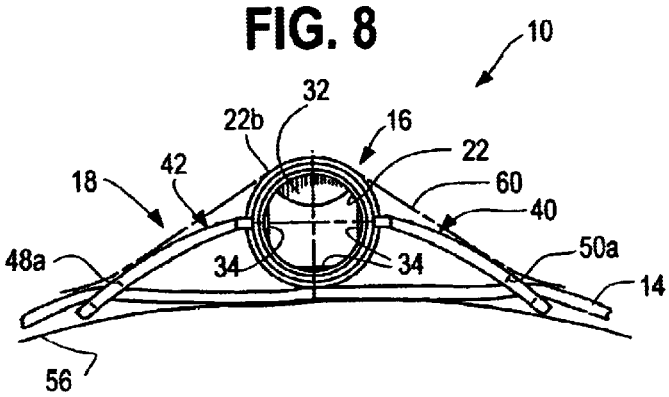
FIG. 8 is a plan view of the scabbard of FIG. 1 shown attached to a fragmentary portion of a belt as worn about a user's waist and with the baton removed from the scabbard.

As illustrated in FIG. 8, when a user wears a belt 14 around, for example the user's waist, as depicted by line 56, the belt establishes a normal line of tension coincident with the belt around the user. When the concealable baton scabbard 10 is attached to the user's belt as by threading the belt through slots 48*a* and 50*a*, the wing members 40 and 42 flex about their lines of connection to the baton receiving core 16 and the belt engages the inner surface of the baton receiving core as shown. With the wing members or panels 40 and 42 flexed arcuately toward the user's waist by the belt 14, a relatively smooth outer profile or contour surface is created by the flexed wing members and outer curvature of the baton receiving core that defines a new line of tension, as indicated generally by dash line 60, which forms a smooth transition from the belt's normal line of tension.

Thus, with the concealable baton scabbard 10 held against the user's waist by the belt 14 as illustrated in FIG. 8, an article of outer clothing that overlies the scabbard and a baton carried therein will lie generally along the smooth path of the line of tension 60 to thereby make the scabbard and baton virtually undetectable when viewed by persons observing the user. That is, the observer will be unaware that the user is carrying a scabbard underneath the user's outer clothing.

While the baton receiving core 16 is illustrated and described as having a cylindrical tubular configuration, it will be understood that the baton receiving core 16 may be formed with other transverse cross-sectional shapes for receiving non-cylindrical shaped intermediate force weapons as may be carried by law enforcement and security personnel. It will also be understood that the wing members or panels 40 and 42 may be formed with alternative elevational profiles such as rectangular or more elongated than the illustrated arcuate shaped wing members. It will be further understood that the wing members or panels 40 and 42 may have single belt receiving slots or more than two such slots.

While a preferred embodiment of the present invention has been illustrated and described, it will be understood that the invention is not limited to the particular details depicted, and that changes and modifications may be made in the aforedescribed scabbard without departing from the true spirit and scope of the invention. For example, the various components of the illustrated scabbard may be made of various materials, such as a lightweight metal, plastics, etc. which exhibit the same rigidity and flexibility as aforedescribed, and which may have different elevational profiles and cross-sectional configurations, such as square, rectangular, circular, etc. It is intended, therefore, that the subject matter herein disclosed be interpreted as illustrative and not in limiting sense. Various features of the invention are defined in the following claims.

What is claimed is:

1. A concealable baton scabbard for supporting a baton on a belt or strap when disposed about a user's waist or torso and wherein the belt or strap defines a line of tension about the user's waist or torso, said scabbard comprising:

a generally tubular baton receiving housing defining a longitudinal axis and having an open upper end adapted to receive and support an elongated baton; and a pair of flexible wing members fixedly attached to said baton receiving housing at substantially diametrically opposite positions on said housing so as to lie generally in a plane containing said longitudinal axis, each of the wing members having at least one belt receiving slot therein, said wing members being adapted for attachment to a belt or strap by enabling the belt or strap to extend through a pair of said slots disposed on opposite sides of said housing so that with the belt disposed about the user's waist or torso the wing members can flex to lie generally proximate the user's torso such that the baton scabbard can be substantially concealed under an article of clothing worn by the user in overlying relation to the scabbard.

2. A concealable baton scabbard as defined in claim 1 wherein said baton receiving housing has an upper open end defining a baton receiving opening inclined at a predetermined angle relative to a longitudinal axis of said housing.

3. A concealable baton scabbard as defined in claim 1 wherein said baton receiving housing has a first pair of tabs extending generally radially outwardly from diametrically opposite sides of the baton housing, said wing members each being secured to a corresponding one of said tabs in fixed relation therewith.

4. A concealable baton scabbard as defined in claim 3 wherein said baton housing has a second pair of tabs extending outwardly from opposite sides of the baton housing so as to longitudinally underlie said first pair of tabs in spaced relation therefrom, said wing members being secured to corresponding pairs of said first and second tabs in fixed relation therewith.

5. A concealable baton scabbard for supporting a baton on a belt or strap when disposed about a user's waist and wherein the belt or strap defines a line of tension about the user's waist, said scabbard comprising:

a generally tubular baton receiving housing defining an interior chamber having an open upper end and adapted to receive and support an elongated baton, said interior chamber having at least one rib member operative to frictional engage a baton inserted into said chamber, and a pair of wing members attached to said baton receiving housing at substantially diametrically opposite sides of said housing, each of the wing members having at least one belt receiving slot therein, said wing members being adapted for attachment to a belt by enabling the belt to extend through a pair of said slots disposed on opposite sides of said housing so that the wing members and baton housing create an outer profile that enables said baton scabbard to be substantially concealed under an article of clothing worn by the user in overlying relation to the scabbard.

6. A concealable baton scabbard as defined in claim 5 wherein said interior chamber has a plurality of said rib members operative to frictionally engage a baton dispose in said chamber.

7. A concealable baton scabbard for supporting a baton on a belt or strap when disposed about a user's waist and wherein the belt or strap defines a line of tension about the user's waist, said scabbard comprising:

a generally tubular baton receiving housing having an open upper end and adapted to receive and support an elongated baton, said tubular baton housing has a first rib extending peripherally about said upper end and a second rib extending peripherally around said bottom end, a pair of wing members attached to said baton receiving housing at substantially diametrically opposite sides of said housing, said first and second wing members being attached to said baton housing between the top and bottom ribs and each of the wing members having at least one belt receiving slot therein, said wing members being adapted for attachment to a belt by enabling the belt to extend through a pair of said slots disposed on opposite sides of said housing so that the wing members and baton housing create an outer profile that enables said baton scabbard to be substantially concealed under an article of clothing worn by the user in overlying relation to the scabbard.

8. A concealable baton scabbard as defined in claim 7 wherein said baton housing has a third rib thereon extending substantially peripherally about the baton housing intermediate said first and second ribs.

9. A concealable baton scabbard as defined in claim 8 wherein said wing members are molded to said baton receiving housing so as to form an annular sleeve coaxial on said baton receiving housing.

10. A concealable baton scabbard as defined in claim 9 wherein each of the wing members has a plurality of said belt receiving slots therethrough.

11. A concealable baton scabbard as defined in claim 10 wherein each of said wing members has at least two belt receiving slots enabling attachment of said scabbard to a belt or strap.

12. A concealable baton scabbard as defined in claim 10 wherein each of said wing members has a plurality of breakaway members enabling enlargement of said belt receiving slots to receive different width belts therethrough.

13. A concealable baton scabbard for supporting a baton on a belt or strap when disposed about a user's waist and wherein the belt or strap defines a line of tension about the user's waist, said scabbard comprising: p1 a generally tubular baton receiving housing having an open upper end adapted to receive an elongated baton and having an open lower end partially closed by a transverse flange disposed at said lower end of said housing, and a pair of wing members attached to said baton receiving housing at substantially diametrically opposite sides of said housing, each of the wing members having at least one belt receiving slot therein, said wing members being adapted for attachment to a belt by enabling the belt to extend through a pair of said slots disposed on opposite sides of said housing so that the wing members and baton housing create an outer profile that enables said baton scabbard to be substantially concealed under an article of clothing worn by the user in overlying relation to the scabbard.

14. A concealable baton scabbard as defined in claim 13 wherein each of the wing members is formed of a flexible material.

15. A concealable baton scabbard for supporting a baton on a belt or strap when disposed about a user's waist and wherein the baton has a tubular handle and at least one telescoping section, said scabbard comprising:

a generally tubular baton receiving housing having a lower end and an open upper end adapted to receive an elongated baton; and a pair of wing members attached to said baton receiving housing at substantially diametrically opposite sides of said housing, each of the wing members having at least one belt receiving slot therein, said wing members being adapted for attachment to a belt by enabling the belt to extend through a pair of said slots disposed on opposite sides of said housing so that the wing members and baton housing create an outer profile that enables said baton scabbard to be substantially concealed under an article of clothing worn by the user in overlying relation to the scabbard, said baton handle having a cross sectional configuration such that the handle of the baton is insertable into said upper open end of the baton housing and is not passable through the lower end of the baton housing, said telescoping section being passable through the open area of the lower end of the baton housing when the baton is in an extended configuration.

16. A concealable baton scabbard for supporting a generally cylindrical baton on a belt or strap adapted for wearing about a user's waist, said scabbard comprising:

a generally tubular baton housing having an interior chamber defining a longitudinal axis and having an open upper end adapted to receive a baton therein, and means for attaching said scabbard to the belt or strap of a user comprising a pair of flexible wing members fixedly attached to generally diametrically opposite sides of said tubular housing, each of the wing members having at least one belt receiving slot spaced from said baton housing and enabling a belt or strap to extend through said slots and hold the scabbard against the user's waist such that the scabbard and a baton disposed in said baton housing are substantially undetectable under an article of clothing disposed in overlying relation to the scabbard.

17. A concealable baton scabbard as defined in claim 16 wherein said tubular baton housing has a bottom end that is partially closed.

18. A concealable baton scabbard as defined in claim 16 wherein said open upper end of said baton housing is inclined at a predetermined angle relative to said longitudinal axis.

19. A concealable baton scabbard as defined in claim 16 wherein each of the wing members is formed of a flexible material.

20. A concealable baton scabbard as defined in claim 16 including at least one baton retaining rib formed on said interior chamber and extending into said chamber.

21. A concealable baton scabbard as defined in claim 20 wherein said internal chamber has a plurality of said retaining ribs formed therein in spaced apart relation.

22. A concealable baton scabbard as defined in claim 16 including at least one pair of tabs extending generally radially from opposite sides of the baton housing, said wing members being secured to said pair of ribs.

23. A concealable baton scabbard as defined in claim 22 including first and second pairs of said tabs extending outwardly from diametrically opposite sides of the baton housing, said wing members each being affixed to a pair of said tabs.

24. A concealable baton scabbard as defined in claim 16 wherein each of the wing members has at least two slots formed therethrough adapted to enable selective positioning of said scabbard relative to a belt or strap for holding the scabbard against the user's waist.

25. A concealable baton scabbard as defined in claim 24 wherein each of the slots lies on a predetermined arc segment relative to said baton housing.

26. A concealable baton scabbard as defined in claim 24 wherein each of the slots has at least one breakaway bar enabling adjustment if the length of the corresponding slot for receiving different width of belts or straps used therewith.

27. A concealable baton scabbard as defined in claim 16 wherein the baton housing includes a rigid tubular sleeve having an upper peripheral rim and a lower peripheral rim, said wing members being molded to said rigid sleeve so as to extend outwardly from substantially diametrically opposite sides of said sleeve between said upper and lower rims.

28. A concealable baton scabbard as defined in claim 27 wherein said rigid sleeve has at least one pair of tabs extending outwardly from diametrically opposite sides thereof, said wing members being affixed to said tabs.

29. A concealable baton scabbard as defined in claim 27 wherein said wing members are molded to said rigid sleeve so as to form a molded annular wall about said rigid sleeve integral with said wing members, and wherein said wing members are molded to said tabs.

30. A concealable baton scabbard as defined in claim 29 wherein said molded wing members are formed from a flexible material.

31. A concealable baton scabbard system for releasably supporting an expandable baton and adapted to be worn on a belt when disposed about the waist of a user so as to define a line of tension around the user's waist, said scabbard system comprising:

a belt adapted to be worn about a user's waist so as to define a line of tension about the user's waist;

a generally tubular baton receiving housing having an interior chamber adapted to receive a baton therein and defining a longitudinal axis, said housing having an open upper end and a bottom end, said tubular baton housing having first and second flexible wing members secured directly to and extending outwardly from substantially diametrically opposite sides of said tubular housing, each of the wing members having at least one belt receiving slot;

said belt being adapted to extend through said belt receiving slots so as to flex said first and second wing members toward a user's waist when the belt is worn about the user's waist, said wing members cooperating with said baton receiving housing to define an outer profile for the scabbard when the belt is taut about the user's waist so that a baton disposed in the baton receiving housing is substantially undetectable under an article of outer clothing worn by the user in overlying relation to the scabbard.

32. A concealable baton scabbard as defined in claim 31 wherein each of the wing members has at least two belt receiving slots positioned to enable the belt to extend through a selected pair of said slots on opposite sides of said baton receiving housing for effecting different scabbard orientations relative to the user's waist when the belt is disposed about the user's waist.

33. A concealable baton scabbard system as defined in claim 31 wherein the baton receiving housing defines a generally cylindrical interior chamber having at least one longitudinally extending rib formed therein for releasably engaging a baton inserted into said interior chamber so as to prevent fill surface contact of said baton with said interior chamber whereby to facilitate withdrawal of the baton from the baton housing.

34. A concealable baton scabbard system as defined in claim 31 wherein said open upper end is inclined relative to said longitudinal axis to facilitate entry of a baton into said interior chamber.

35. A concealable baton scabbard for supporting a baton on a belt or strap when disposed substantially about a user's waist, said scabbard comprising:

a generally rigid tubular baton receiving housing having an open upper end adapted to receive an elongated baton; and a pair of flexible wing members attached directly to said baton receiving housing at substantially diametrically opposite sides of said housing, each of the wing members having a plurality of belt receiving slots therein, said wing members being adapted for attachment to a belt or strap by enabling the belt or strap to extend through a selected pair of said slots disposed on opposite sides of said housing so that the baton scabbard can be secured about the user's waist or torso with the baton receiving housing disposed in different selected angular orientations relative to the user and substantially concealed under an article of clothing worn by the user in overlying relation to the scabbard.

36. A concealable baton scabbard as defined in claim 35 wherein each of said slots includes means enabling selective adjustment of the longitudinal length of the slot.

37. A concealable baton scabbard as defined in claim 36 wherein said slot length adjustment means includes a plurality of breakaway bars formed generally transverse to the longitudinal length of each said slot.

* * * * *